US012330702B2

(12) United States Patent
Vorren et al.

(10) Patent No.: US 12,330,702 B2
(45) Date of Patent: Jun. 17, 2025

(54) DATA PROCESSING FOR INFRASTRUCTURAL MONITORING

(71) Applicant: KONUX GMBH, Munich (DE)

(72) Inventors: Ole Vorren, Munich (DE); Olav Stetter, Munich (DE)

(73) Assignee: KONUX GMBH, Munich (DE)

( * ) Notice: Subject to any disclaimer, the term of this patent is extended or adjusted under 35 U.S.C. 154(b) by 205 days.

(21) Appl. No.: 18/042,542

(22) PCT Filed: Aug. 26, 2021

(86) PCT No.: PCT/EP2021/073650
§ 371 (c)(1),
(2) Date: Feb. 22, 2023

(87) PCT Pub. No.: WO2022/043458
PCT Pub. Date: Mar. 3, 2022

(65) Prior Publication Data

US 2023/0331268 A1 Oct. 19, 2023

(30) Foreign Application Priority Data

Aug. 31, 2020 (EP) ..... 20193665
Dec. 4, 2020 (EP) ..... 20212001

(51) Int. Cl.
*B61L 27/70* (2022.01)
*B61L 15/00* (2006.01)
(Continued)

(52) U.S. Cl.
CPC ..... *B61L 27/70* (2022.01); *B61L 15/0081* (2013.01); *B61L 25/023* (2013.01); *B61L 27/53* (2022.01); *B61L 27/57* (2022.01)

(58) Field of Classification Search
CPC ..... B61L 27/70; B61L 27/53; B61L 27/57; B61L 15/0081; B61L 25/023
See application file for complete search history.

(56) References Cited

U.S. PATENT DOCUMENTS 9,684,006 B2 6/2017 Pollack
2017/0176192 A1 6/2017 Cardoso
(Continued)

FOREIGN PATENT DOCUMENTS

AU 785492 B2 * 12/2007 ..... B61L 23/00
CN 204630612 U * 9/2015
(Continued)

OTHER PUBLICATIONS

Küçükkeçeci et al; Multilevel Object Tracking in Wireless Multimedia Sensor Networks for Surveillance Applications Using Graph-Based Big Data; IEEE Access; Digital Object Identifier 10.1109/ACCESS.2019.2918765; Jun. 5, 2019; vol. 7, 2019; pp. 67818-67832 (Year: 2019).*
(Continued)

*Primary Examiner* — Michael J Zanelli
(74) *Attorney, Agent, or Firm* — Tarolli, Sundheim, Covell & Tummino LLP

(57) ABSTRACT

The invention relates to automatically determining an efficient topology of sensor network preferably installed in an infrastructure, such as railway infrastructure. The invention discloses a system, a method, a user device. The invention further provides a processing component configured to receive sensor data from at least one or a plurality of sensor node(s). Further, the invention provides a trajectory module, configured to generate at least a part of trajectory data based on sensor data.

15 Claims, 2 Drawing Sheets

(51) Int. Cl.

| | |
|---|---|
| ***B61L 25/02*** | (2006.01) |
| ***B61L 27/53*** | (2022.01) |
| ***B61L 27/57*** | (2022.01) |

(56) References Cited

U.S. PATENT DOCUMENTS

| | | | | |
|---|---|---|---|---|
| 2017/0313331 | A1* | 11/2017 | Hilleary | B61L 17/02 |
| 2020/0010101 | A1* | 1/2020 | Alessi | B61L 27/53 |
| 2021/0122402 | A1* | 4/2021 | Böhm | B61L 23/045 |
| 2021/0300389 | A1* | 9/2021 | McGill | G06F 18/2413 |

FOREIGN PATENT DOCUMENTS

| | | | | | |
|---|---|---|---|---|---|
| CN | 109547938 | B | * | 8/2020 | G01C 21/20 |
| WO | 2019086095 | A1 | | 5/2019 | |
| WO | 2019185872 | A1 | | 10/2019 | |
| WO | 2019185873 | A1 | | 10/2019 | |
| WO | 2020002018 | A1 | | 1/2020 | |
| WO | 2020002019 | A1 | | 1/2020 | |

OTHER PUBLICATIONS

International Search Report dated Jan. 5, 2022 for corresponding International Application No. PCT/EP2021/073650.

* cited by examiner

DATA PROCESSING FOR INFRASTRUCTURAL MONITORING

RELATED APPLICATIONS

The present application is a U.S. National Stage application under 35 USC 371 of PCT Application Serial No. PCT/EP2021/073650, filed on 26 Aug. 2021, which claims priority to EP patent application No. 20193665.5, filed 31 Aug. 2020, and EP patent application No. 20212001.0, filed 4 Dec. 2020, the entirety of each of which is incorporated herein by reference.

FIELD

The invention relates to automatically determining an efficient topology of sensor network preferably installed in an infrastructure, such as railway infrastructure.

BACKGROUND

Sensor Networks constitute pervasive and distributed computing systems and are potentially one of the most important technologies of this century. They have been specifically identified as a good candidate to become an integral part of the protection of critical infrastructures, such as rail infrastructure. Wired sensor systems have been widely used for a long time in Structural health monitoring (SHM). It is noted that wired systems seem to be commonly used at large scales. However, due to their own limitations, this technique requires high cost and complex installation processes that are inconvenient and have led to the adoption of wireless sensor networks (WSNs) as an alternative approach. Besides providing real time monitoring and alert for preventing damage and failure, this technique can improve the decision-making process in maintenance based on failure prediction rather than on routine operations or execution of work after failure. In addition, the lower power consumption and relatively low costs of theses sensors when compared to traditional sensor technology can reduce the impact of damaged or lost equipment.

Moreover, WSNs have proved that they can be used under severe weather conditions, such as strong wind, storms and snow, whilst the wired traditional technique is vulnerable to damage (e.g., corrosion), vandalism (e.g., cut wire), dirt and nature elements. It is also worth mentioning that WSNs offer many possibilities previously unavailable with traditional sensor technology. In terms of time, the wireless sensing units can be installed with ease and completed in approximately half the time of the wired monitoring system because they require less labour-intensive work and no special care to ensure safe placement of wires on the structure. However, it is preferable to combine periodic visual inspection and a WSN condition monitoring system for maintaining railway structures, as this enables an effective periodic inspection of structures depending on the degree of importance of each monitored component based on the detailed data supplied by the WSN.

The deterioration of rail infrastructure is a significant issue throughout the world. Railway inspection is normally conducted periodically every year or several months. It may take too much time to rapidly detect faults in the track that may cause collapse or huge loss, as is the case in the prompt identification of rail defects. The railway industry needs to improve the process and decision thinking of track maintenance. Hence, condition monitoring of rail infrastructure has become important for setting proper predictive maintenances before defect and failure take place. Structural health monitoring (SHM) has been widely developed over the past decade with many civil engineering applications, such as building, bridge, off-shore structure, in order to enhance the safety and reliability. Condition monitoring can reduce maintenance and its costs by detecting the faults before they can cause damage or prevent rail operations.

In addition, visual inspection requirements can be reduced through automated monitoring. Several sensors may be adopted for railway monitoring such as accelerometers, strain gauges, acoustic emission and inclinometers. Apart from detecting defects in rail infrastructure, other benefits of a monitoring system integrating these sensors are to determine the number of axles, number of trains, their speed, acceleration and weight, which are important for adequate management.

Further, the installation of these wireless sensing units can be optimized using the knowledge of network topology.

For example, US20170176192A1 discloses communication network architectures, systems and methods for supporting a network of mobile nodes. As a non-limiting example, various aspects of this disclosure provide communication network architectures, systems, and methods supporting the collection of various kinds of data by mobile and fixed nodes and user devices operating in a geographic area, and the extrapolation from that data of information having significant value to various organizations operating in the geographic area.

U.S. Pat. No. 9,684,006B2 discloses methods and systems for use with an automation system in an automated clinical chemistry analyzer can include one or more surfaces configured to dynamically display a plurality of optical marks, a plurality of independently movable carriers configured to move along surfaces and to observe them to determine navigational information from the plurality of optical marks, and a processor configured to update the plurality of optical marks to convey information that pertains to each respective independently movable carrier. The plurality of marks can include two-dimensional optically encoded marks, barcodes oriented in a direction of travel of the carriers, marks that dynamically convey data, dynamic lines configured to be followed by the carriers, marks indicating a collision zone, or dynamic marks displayed at a location coincident with the location of a pipette.

SUMMARY

In light of the above, it is an object of the present invention to overcome or at least alleviate the shortcomings of the prior art. More particularly, it is an object of the present invention to provide an efficient sensor monitoring system and method, preferably using network topology.

In a first embodiment a system comprising a processing component is disclosed. The system comprises a plurality of sensor nodes. The processing component is configured to receive sensor data from the sensor node. The system further comprises at least one trajectory module. The trajectory module may be configured to generate at least a part of trajectory data based on sensor data.

In some embodiments the processing component may be configured to pull user data from a user device. The user device may comprise a smart phone, a smart phone application, a computer, a laptop or the alike.

In some embodiments the system may comprise a server. The server may be a remote server and/or a local server. The system may further comprise a storage component. In some embodiments the server may comprise a storage component.

In some embodiments the processing component and the at least one sensor node may be integrated in a single unit. The single unit may comprise a computing unit.

In some further embodiments the user device may be configured to be in a proximity of the at least one sensor node. In such embodiments the proximity may comprises a radius of at most 10 km.

In some embodiments the system may comprise at least one base station. The base station may be configured to exchange data with the sensor nodes in a pre-determined radius. In such embodiments the pre-determined radius may comprise a range up to 10 km, such as 1 km to 5 km.

In some embodiments the user device may be configured to exchange data with the at least one base station. Further, the sensor node may be configured to be installed in a railway infrastructure.

In some embodiments the trajectory module may be configured to pull sensor data from the processing component. Further, in such embodiments the trajectory module may be configured to pull raw user data from the user device.

In some embodiments the trajectory module may be configured to exchange data with the at least one base station. In some further embodiments the trajectory module may be configured to fuse data sourced by the at least two of sensor node and base station and processing component and input data.

In some embodiments the processing component and the trajectory modules may be integrated in a single unit. The trajectory module may further be configured to generate trajectory data based on sensor data and/or raw sensor data.

In some embodiments the trajectory module may comprise a computing module configured to analyze railway trajectories, such as train paths, schedules, etc. In some further embodiments the trajectory module may be configured to generate trajectory data based on the at least one of user data and raw user data.

In some embodiments the trajectory module may be configured to generate trajectory data based on labelled input data. The labelled input data may comprise network topology data.

In some embodiments the sensor data may comprise network topology data. The trajectory module may further be configured to generate trajectory data based on unlabeled input data.

In some embodiments the input data may comprise schedule data, network topology data, train routes data, etc. In some further embodiments the input data may comprise load data. In such embodiments the load data may be extracted from weighing stations, installed in railway infrastructure.

In some embodiments the trajectory module may comprise at least one neural network architecture. The neural network architecture may comprise a deep neural network architecture.

In some embodiments the neural network architecture may comprise a convolutional neural network architecture. In some further embodiments the neural network architecture may comprise a residual neural network architecture.

In some embodiments the trajectory module may comprise an unsupervised and/or a semi-supervised machine learning component. In such embodiments the machine learning component comprises the neural network architecture. The machine learning component may be configured to generate trajectory data.

In some embodiments the trajectory data may comprise direction data. The direction data may be the direction of the railway traffic with respect to the sensor node. The trajectory data may be generated based on at least frequency data recorded at the at least one sensor node.

In some embodiments the trajectory data may be configured to be predicted based on at least frequency data recorded at the at least one sensor node. The trajectory data may further comprise at least one change in direction of a moving object, such as passenger trains, cargos in a railway infrastructure.

In some embodiments the trajectory data may be predicted based on electric current variation in at the at least one sensor node. In such embodiments the sensor node may be installed in the railway infrastructure.

In some embodiments the direction data may be predicted based on electric current variation in a point machine. In some further embodiments the trajectory data may be predicted based on the sensor data from the plurality of sensors.

In some embodiments the trajectory data may be generated based on the sensor data from the plurality of sensor using the time shift method. The trajectory data may further be generated based on user data sensed by the user device. In such embodiments the user device may comprise at least one of smart phone and wearable and smart phone application.

In some embodiments the system may comprise a sensor routine module. The sensor routine module may be configured to generate sensor installing data. In such embodiments the sensor installing data may comprise at least one of optimized geographical location for sensor node placement and/or an optimized number of sensor nodes to be placed and/or installed.

In some embodiments the sensor routine module may be configured to generate sensor activation data. In such embodiments the sensor activation data may comprise at least one of at least an optimized time period the sensor node may be activated for and at least one sensor node to be activated at a pre-determined time.

In some further embodiments the sensor routine module may be configured to extract the trajectory data from the trajectory module. The sensor routine module may be configured to generate at least part of sensor installing data based on trajectory data.

In some embodiments the sensor routine module may be configured to at least part of sensor activation data based on trajectory data. In some further embodiments the sensor routine module may comprise the neural network architecture.

In some further embodiments the sensor routine module may comprise a self-improving neural network architecture. The sensor routine module be configured to generate the at least one of sensor installing data and sensor activation data based on historical data.

In some further embodiments the historical data may comprise network topology data, wherein the network topology data may be stored at the server.

In a second embodiment a method comprising the step of obtaining sensor data from at least one or a plurality of sensor nodes is disclosed. The method also comprises the step of automatically generating at least part of trajectory data based on sensor data. The method may comprise the step of being carried out on the system according to any of the system embodiments.

In a third embodiment a user device is disclosed. The user device may comprise a device processing component, an interface and a memory component. The device may be configured to carry out the relevant method steps.

The invention is further described with the following numbered embodiments.

Below, system embodiments will be discussed. These embodiments are abbreviated by the letter "S" followed by a number. Whenever reference is herein made to "system embodiments", these embodiments are meant.

S1. A system, comprising:
  a. at least one processing component;
  b. a plurality of sensor nodes;
  c. wherein, the processing component is configured to receive sensor data from the sensor nodes; and
  d. at least one trajectory module, configured to generate at least a part of trajectory data based on sensor data.

S2. The system according to the preceding embodiment wherein the processing component is configured to pull user data from a user device.

S3. The system according to any of the preceding embodiments wherein the system comprises a server.

S4. The system according to any of the preceding embodiments wherein the server comprises a storage component.

S5. The system according to any of the preceding embodiments wherein the processing component and the at least one sensor node are integrated in a single unit.

S6. The system according to any of the preceding embodiments wherein the user device is configured to be in a proximity of the at least one sensor node.

S7. The system according to the preceding embodiment wherein the proximity comprises a radius of at most 10 km.

S8. The system according to any of the preceding embodiments wherein the system further comprises at least one base station.

S9. The system according to any of the preceding embodiments wherein the base station is configured to exchange data with the at least one sensor node.

S10. The system according to any of the preceding embodiments wherein the base station comprises a machine learning architecture.

S11. The system according to the preceding embodiment wherein the machine learning architecture comprises a neural network classifier.

S12. The system according to any of the preceding embodiments wherein the base station further comprises an autoencoder configured to process the sensor data.

S13. The system according to any of the preceding embodiments wherein the base station is configured to exchange data with the sensor nodes in a pre-determined radius.

S14. The system according to the preceding embodiment wherein the pre-determined radius comprises a range of up to 10 km, such as 1 km to 5 km.

S15. The system according to any of the preceding embodiments wherein the processing component is installed at the base station.

S16. The system according to any of the preceding embodiments wherein the user device is configured to exchange data with the at least one base station.

S17. The system according to any of the preceding embodiments wherein the sensor nodes are configured to be installed in a railway infrastructure.

Embodiments Related to Trajectory Module

S18. The system according to any of the preceding embodiments wherein the trajectory module is configured to pull sensor data from the processing component.

S19. The system according to any of the preceding embodiments wherein the trajectory module is configured to pull raw user data from the user device.

S20. The system according to any of the preceding embodiments wherein the trajectory module is configured to pull raw sensor data from the at least one sensor node.

S21. The system according to any of the preceding embodiments wherein the trajectory module is configured to exchange data with the at least one base station.

S22. The system according to any of the preceding embodiments and features of S13 to S16 wherein the trajectory module is configured to fuse data sourced by the at least two of sensor node and/or base station and/or processing component and/or user device.

S23. The system according to any of the preceding embodiments wherein the processing component and the trajectory module are integrated in a single unit.

S24. The system according to any of the preceding embodiments wherein the trajectory module is configured to generate trajectory data based on sensor data and raw sensor data.

S25. The system according to any of the preceding embodiments wherein the trajectory module is configured to generate trajectory data based on the at least one of user data and raw user data.

S26. The system according to any of the preceding embodiments wherein the trajectory module is configured to generate trajectory data based on labelled input data.

S27. The system according to any of the preceding embodiments wherein the trajectory module is configured to generate trajectory data based on unlabeled input data.

S28. The system according to the preceding two embodiments wherein the input data comprises schedule data.

S29. The system according to any of the preceding embodiments wherein the input data comprises load data, preferably from the weighing stations.

S30. The system according to any of the preceding embodiments wherein the trajectory module comprises at least one neural network architecture.

S31. The system according to the preceding embodiment wherein the neural network architecture comprises a deep neural network architecture.

S32. The system according to any of the preceding two embodiments wherein the neural network architecture comprises a convolutional neural network architecture.

S33. The system according to the preceding three embodiments wherein the neural network architecture comprises a residual neural network architecture.

S34. The system according to any of the preceding embodiments wherein the trajectory module further comprises an unsupervised or a semi supervised machine learning component.

S35. The system according to any of the preceding embodiments wherein the machine learning component comprises the neural network architecture.

S36. The system according to any of the preceding embodiments wherein the machine learning component is configured to generate trajectory data.

Embodiments Related to Trajectory Data

S37. The system according to any of the preceding embodiments wherein the trajectory data at least comprises direction data.

S38. The system according to any of the preceding embodiments wherein the trajectory data is configured to be generated based on at least frequency data recorded at the at least one sensor node.

S39. The system according to the preceding embodiments wherein the trajectory data is predicted based on at least frequency data recorded at the at least one sensor node.

S40. The system according to any of the preceding embodiments wherein the sensor data comprises at least one of frequency data and acceleration data and acoustic data and pressure data and strain data and humidity data and temperature data and inclination data.

S41. The system according to any of the preceding embodiments wherein the trajectory data comprises at least one change in direction of a moving object, such as passenger trains, cargos in a railway infrastructure.

S42. The system according to any of the preceding embodiments wherein the trajectory data is predicted based on electric current variation in at the at least one sensor node.

S43. The system according to any of the preceding embodiments wherein the direction data is predicted based on electric current variation in a point machine.

S44. The system according to any of the preceding embodiments wherein the trajectory data is configured to be predicted based on the sensor data from the plurality of sensors.

S45. The system according to any of the preceding embodiments wherein the trajectory data is generated based on the sensor data from the plurality of sensor nodes using the time shift method.

S46. The system according to any of the preceding embodiments wherein the trajectory data is generated based on user data sensed by the user device.

S47. The system according to the preceding embodiment wherein the user device comprises at least one of smart phone and wearable and smart phone application.

S48. The system according to any of the preceding embodiments wherein the trajectory module is installed to the base station.

S49. The system according to any of the preceding embodiments wherein the machine learning architecture installed at the base station is further configured to generate at least one AI model, preferably based on sensor data.

S50. The system according to any of the preceding embodiments wherein the trajectory module is configured to generate trajectory data based on the AI model.

Embodiments Related to Sensor Routine Module

S51. The system according to any of the preceding embodiments wherein the system comprises a sensor routine module.

S52. The system according to any of the preceding embodiments wherein the sensor routine module is configured to generate sensor installing data.

S53. The system according to the preceding embodiment wherein sensor installing data comprises at least one of optimized geographical location for sensor node installment and an optimized number of sensor nodes to be installed.

S54. The system according to any of the preceding embodiments wherein the sensor routine module is configured to generate sensor activation data.

S55. The system according to the preceding embodiment wherein the sensor activation data comprises at least one of at least an optimized time period the sensor node is activated for and at least one sensor node to be activated at a pre-determined time.

S56. The system according to any of the preceding embodiments wherein the sensor routine module is configured to extract the trajectory data from the trajectory module.

S57. The system according to any of the preceding embodiments wherein the sensor routine module is configured to generate at least part of sensor installing data based on trajectory data.

S58. The system according to any of the preceding embodiments wherein the sensor routine module is configured to generate at least part of sensor activation data based on trajectory data.

S59. The system according to any of the preceding embodiments wherein the sensor routine module comprises the neural network architecture.

S60. The system according to any of the preceding embodiments wherein the sensor routine module comprises a self-improving neural network architecture.

S61. The system according to any of the preceding embodiments wherein the sensor routine module generates the at least one of sensor installing data and sensor activation data based on historical data.

S62. The system according to the preceding embodiment wherein the historical data comprises network topology data, preferably stored at the server.

Below, method embodiments will be discussed. These embodiments are abbreviated by the letter "M" followed by a number. Whenever reference is herein made to "method embodiments", these embodiments are meant.

M1. A method comprising the step of:

a. obtaining sensor data from at least one or a plurality of sensor node(s);

b. automatically generating at least part of trajectory data based on sensor data.

M2. The method according to the preceding embodiment wherein the method comprises carrying out the method on the system according to any of the preceding system embodiments.

M3. The method according to any of the preceding embodiments wherein the method comprises automatically pulling sensor data from the processing component.

M4. The method according to any of the preceding embodiments wherein the method comprises automatically providing the sensor data to a trajectory module.

M5. The method according to any of the preceding embodiments wherein the method comprises fusing data sourced by at the at least two of sensor node and base station and processing component and input data.

M6. The method according to any of the preceding embodiments wherein the method comprises generating trajectory data based on the at least one of user data and raw user data.

M7. The method according to any of the preceding embodiments wherein the method comprises automatically predicting the trajectory data.

M8. The method according to any of the preceding embodiments wherein the method comprises generating sensor installing data.

Below, device embodiments will be discussed. These embodiments are abbreviated by the letter "D" followed by a number. Whenever reference is herein made to "device embodiments", these embodiments are meant.

D1. A user device comprising:

a. a device processing component, configured to generate at least part of user data;

b. an interface, configured to pull at least one user input; and c. a memory component, configured to store the user input.

D2. The device according to any of the preceding embodiments wherein the device is further configured with machine learning techniques, preferably machine learning classifiers.

D3. The device according to any of the preceding device embodiments, wherein the device is configured to carry out the steps of the method according to any of the preceding method embodiments.

D4. The device according to any of the preceding device embodiments, wherein the device is configured to exchange data with the at least one sensor node, wherein the sensor node is according to any of the system embodiment.

Below, use embodiments will be discussed. These embodiments are abbreviated by the letter "U" followed by a number. Whenever reference is herein made to "use embodiments", these embodiments are meant.

U1. Use of the system according to any of the preceding system embodiments for carrying out the method according to any of the preceding method embodiments.

U2. Use of the method according to any of the preceding method embodiments, the device according to any of the preceding device embodiments and the system according to any of the preceding system embodiments for generating and analysing synthetic data.

Below, program embodiments will be discussed. These embodiments are abbreviated by the letter "P" followed by a number. Whenever reference is herein made to "program embodiments", these embodiments are meant.

P1. A computer program product comprising instructions, which, when the program is executed by a user device, causes a user device to perform the method steps according to any method embodiment, which have to be executed on the user device, wherein the user device is according to any system embodiment that comprises a user device that is compatible to said method embodiment.

P2. A computer program product comprising instructions, which, when the program is executed by a combination of a server and user device, cause the server and the user device to perform the method steps according to any method embodiment, which have to be executed on the server and the user device, wherein the user device and the server is according to any system embodiment that comprises a sever and/or the user device that is compatible to said method embodiment.

P3. A computer program product comprising instructions, which, when the program is executed by a server, cause the server to perform the method steps according to any method embodiment, which have to be executed on the server, wherein the server is according to any system embodiment that comprises a server that is compatible to said method embodiment.

P4. A computer program product comprising instructions, which, when the program is executed by a processing component, cause the processing component to perform the method steps according to any method embodiment, which have to be executed on the processing component, wherein the processing component is according to any system embodiment that comprises a processing component that is compatible to said method embodiment.

BRIEF DESCRIPTION OF THE DRAWINGS

The present invention will now be described with reference to the accompanying drawings, which illustrate embodiments of the invention. These embodiments should only exemplify, but not limit, the present invention.

DETAILED DESCRIPTION OF THE DRAWINGS

In the following description, a series of features and/or steps are described. The skilled person will appreciate that unless explicitly required and/or unless requires by the context, the order of features and steps is not critical for the resulting configuration and its effect. Further, it will be apparent to the skilled person that irrespective of the order of features and steps, the presence or absence of time delay between steps can be present between some or all of the described steps.

It is noted that not all the drawings carry all the reference signs. Instead, in some of the drawings, some of the reference signs have been omitted for sake of brevity and simplicity of illustration. Embodiments of the present invention will now be described with reference to the accompanying drawings.

Figure 1:
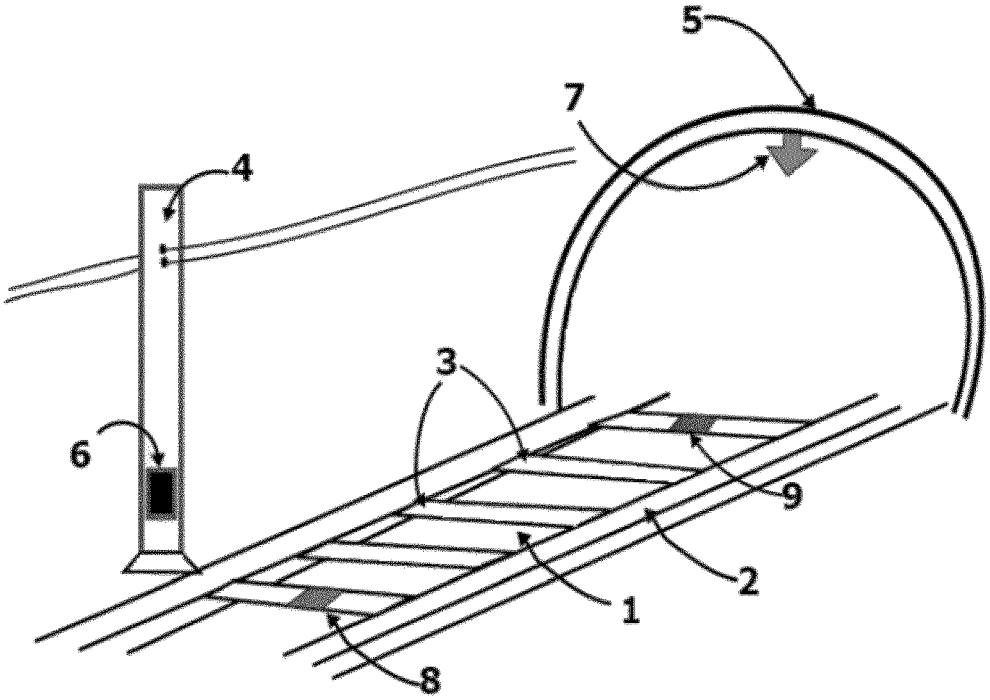
FIG. 1 schematically depicts an embodiment of a sensor node routing in a railway infrastructure.

FIG. 1 illustrates an embodiment of a sensor node 1-9 routing in a railway infrastructure. There is shown an example of a railway section with the railway itself, comprising rails and sleepers. Instead of the sleepers also a solid bed for the rails can be provided. Moreover, a mast that is just one further example of constructional elements that are usually arranged at or in the vicinity of railways. A sensor node 1-9 can be arranged on one or more of the sleepers. The sensor can comprise an acceleration sensor and/or any other kind of railway specific sensor. The sensor node 1-9 can further comprise a wireless sensor network. The sensor node can transmit data to a base station (not shown here). The base station can be installed to the railway infrastructure. The base station can also be installed in the surroundings of the railway infrastructure. The base station can also be a remote base station. The communication module between the base station and the sensor node(s) can comprise, for example Xbee with a frequency of 868 MHz.

The sensor node(s) 1-9 can also be installed in cases and inserted inside the railway infrastructure, for example inside a special hole carved into the concrete. The case can also be attached to the railway infrastructure using fixers. The sensor node 1-9 can be obtaining sensor data based on acceleration, inclination, distance, etc.

The sensor node 1-9 may further be divided into group, for example based on the distance. The sensor node 1-9 lying within a pre-determined distance may be controlled by one base station. The sensor node 1-9 can also be installed on the moving railway infrastructure such as on-board of a vehicle. The sensor node 1-9 can comprise an amplifier to amplify any signal received by the base station.

The sensor nodes 1-9 can be installed such that the sensor node lying within one group can communicate with their base station in one-hop. The base station can receive information from its 'neighbors' and retransmit all the information to the server 800.

The sensor node 1-9 can comprise sensor(s). The sensor can be accelerometers, such as Sensor4PRI for example ADCL 345, SQ-SVS etc. The sensor node 1-9 can comprise inclinometers, such as SQ-SI-360DA, SCA100T-D2, ADXL345 etc.

The sensor node can further comprise distance sensors. The distance sensors can be configured to at least measure the distance between slab tracks, using infrared and/or ultrasonic. The distance sensor can be for example, MB1043, SRF08, PING, etc.

The sensor node 1-9 can comprise visual sensors, such as 3D cameras, speed enforcement cameras, traffic enforcement cameras, etc. It may be noted that sensor node 1-9 may comprise sensors to observe the physical environment of the infrastructure the sensor node 1-9 are installed in. For example, temperature sensor, humidity sensor, altitude sensor, pressure sensor, GPS sensor, water pressure sensor, piezometer, multidepth deflectometers (MDD), etc.

The sensor node 1-9 can be installed to the railway structure depending on the sensor. For example, the strain gauge sensor can be most efficient when installed to the rail. The piezometer can be installed to the sub-ballast. The LVDT sensor can be installed to the sleeper. One sensor node 1-9 can be installed to more than one places.

The sensor node 1-9 can be installed according to a protocol based on routing trees to be able to transmit information to the base station. Once the information has been received, the UMTS technology can be used to send sensor data to a remote server 800.

The sensor node 1-9 can comprise an analog-to-digital converter, a micro controller, a transceiver, power and memory. One or more sensor(s) can be embedded in different elements and can be mounted on boards to be attached to the railway infrastructure. The sensor node 1-9 can also comprise materializing strain gauges, displacement transducers, accelerometers, inclinometers, acoustic emission, thermal detectors, among others. The analog signal outputs generated by the sensors can be converted to digital signals that can be processed by digital electronics. The data can then be transmitted to the base station by a microcontroller through a radio transceiver. All devices can be electric or electronic components supported by power supply, which can be provided through batteries or by local energy generation (such as solar panels), the latter mandatory at locations far away from energy supplies.

The sensor data collected from the sensor nodes 1-9 can be transferred to the base station using wireless communication technology such as CAN, FlexRay, Wi-Fi or Bluetooth. For example, the ZigBee network can be advantageous to consumes less power. On the other hand, for transmitting the input 101 data from the base station to the server 800 long-range communication such as GPRS, EDGE, UMTS, LTE or satellite can be used. Due to the short transmission range, communications from sensor nodes may not reach the base station, a problem that can be overcome by adopting relay nodes to pass the data from the sensor nodes 1-9.

Figure 2:
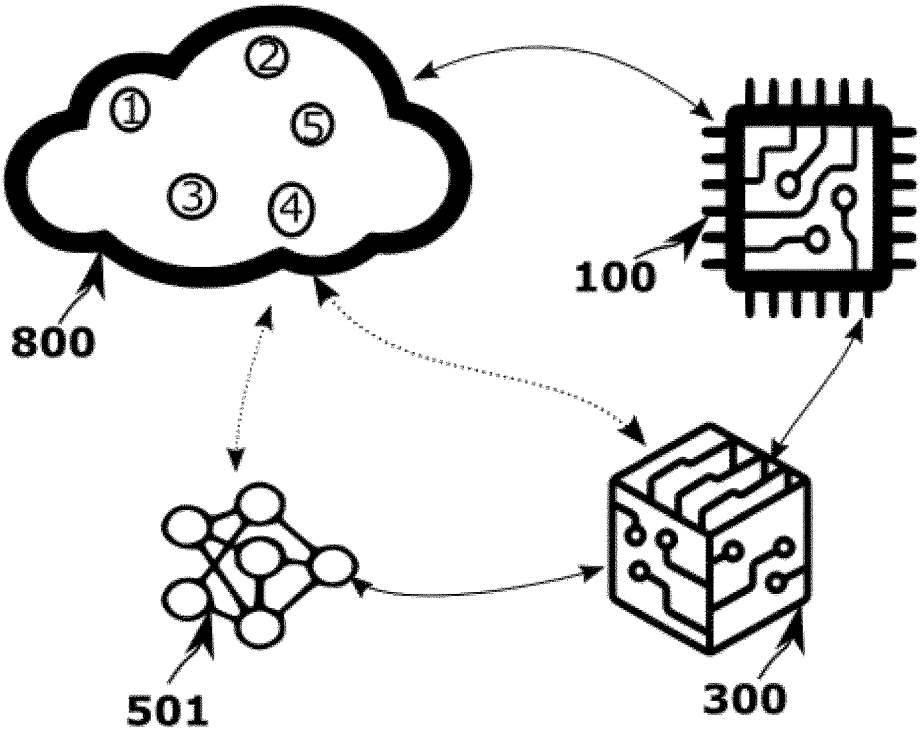
FIG. 2 depicts a system embodiment according to an aspect of the present invention.

FIG. 2 depicts a system according to an aspect of the present invention. The server 800, The collected sensor data can be transmitted to the server 800 server through long-range communications such as GPRS, EDGE, UMTS, LTE or satellite. The sensor node 1-9 can also communicate directly with the server 800 without requiring the use of the base station as a gateway.

The server 800 may comprise a data transmitting component may be configured to establish a bidirectional communication with the base station. In other words, the server 800 may retrieve sensor data from the base station, and further may provide it to the processing component 100, for example, vibrational data.

In one embodiment, the server 800 may comprise a cloud server, a remote server and/or a collection of different type of servers. Therefore, the server 800 may also be referred to as cloud server 800, remote server 800, or simple as servers 800. In another embodiment, the servers 800 may also converge in a central server.

It will be understood that the server 800 may also be in bidirectional communication with a storage component and an interface component. The storage component may be configured to receive information from the server 800 for storage. In simple words, the storing component 800 may store information provided by the servers 800. The information provided by the server 800 may include, for example, but not limited to, data obtained by sensor nodes 1-9, data processed by the processing component 100 and any additional data generated in the servers 800 or the processing component 800.

It will be understood that the servers 800 may be granted access to the storage component comprising, inter alia, the following dictions about future or otherwise unknown events.

The storage component can comprise comprises a volatile or non-volatile memory, such as a random-access memory (RAM), Dynamic RAM (DRAM), Synchronous Dynamic RAM (SDRAM), static RAM (SRAM), Flash Memory, Magneto-resistive RAM (MRAM), Ferroelectric RAM (F-RAM), or Parameter RAM (P-RAM).

It will also be understood that the term server may also refer to a computer program, and/or a device, and/or a plurality of each or both that may provide functionality for other programs, devices and/or components of the present invention. For instance, a server may provide various functionalities, which may be referred to as services, such as, for example, sharing data or resources among multiple clients, or performing computation and/or storage functions. It will further be understood that a single server may serve multiple clients, and a single client may use multiple servers. Furthermore, a client process may run on the same device or may connect over a network to a server on a different device, such as a remote server or a cloud. The server may have rather primitive functions, such as just transmitting rather short information to another level of infrastructure, or can have a more sophisticated structure, such as a storing, processing and transmitting unit.

The processing component 100 can comprise a CPU (central processing unit), GPU graphical processing unit), DSP (digital signal processor), APU (accelerator processing unit), ASIC (application-specific integrated circuit), ASIP (application-specific instruction-set processor) or FPGA (field programmable gate array) or any combination thereof.

The processing component 100 can further be generating the structured database using the sensor data. The structured database may comprise. The processing component 100 can be configured to automatically recognize the sensor associated with the sensor data and can further generate structured database 103 based on the type of the sensor.

The processing component 100 can be configured with machine learning techniques, such as pattern recognition.

The processing component can further be configured to generate labeled data using the structured database and/or the sensor data.

The processed data, meaning the data transmitting from the processing component 100 which can comprise the structured database and/or the labeled data. The processed data can be then automatically pulled by the trajectory module 300. The trajectory module 300 can comprise generating trajectory data based on at least the sensor data (temperature, waves, speed, etc.).

The trajectory module 300 may comprise of a computer program product which can be configured to be programmed based on at least one of dynamical systems, statistical models, differential equations, game theoretic models, logic. The trajectory module 300 can be equipped with neural networks. The trajectory module 300 can further be configured to automatically learn the at least one of governing equations, assumptions, constraints using an existing knowledgebase. The trajectory module 300 can also learn using the sensor data and/or user data and/or input data.

The trajectory data generated by the trajectory module 300 can be automatically fed to the sensor routine module 501. The sensor routine module 501 can comprise a machine learning classifier. The sensor routine module 501 may be trained using the trajectory data to generate labeled input data. The sensor routine module 501 can be configured to generate the labeled data by using at least one of k-nearest neighbor, case-based reasoning, artificial neural networks, Naïve Bayes, etc.

The sensor routine module 501 can further be configured to predict at least one infrastructural feature (ballast, frog, geometry, speed, etc.) based on the labeled data and can further transmit the results to a user device.

The user device can comprise a memory component such as, main memory (e.g. RAM), cache memory (e.g. SRAM) and/or secondary memory (e.g. HDD, SDD). The user device 200 may also comprise at least of an output user interface, such as: screens or monitors configured to display visual data (e.g. displaying graphical user interfaces of the questionnaire to the user), speakers configured to communicate audio data (e.g. playing audio data to the user). The user device can also comprise an input user interface, such as, camera configured to capture visual data (e.g. capturing images and/or videos of the user), microphone configured to capture audio data (e.g. recording audio from the user), and a keyboard configured to allow the insertion of text and/or other keyboard commands (e.g. allowing the user to enter text data and/or another keyboard and mouse, touchscreen, joystick—configured to facilitate the navigation through different graphical user interfaces of the questionnaire.

Figure 3:
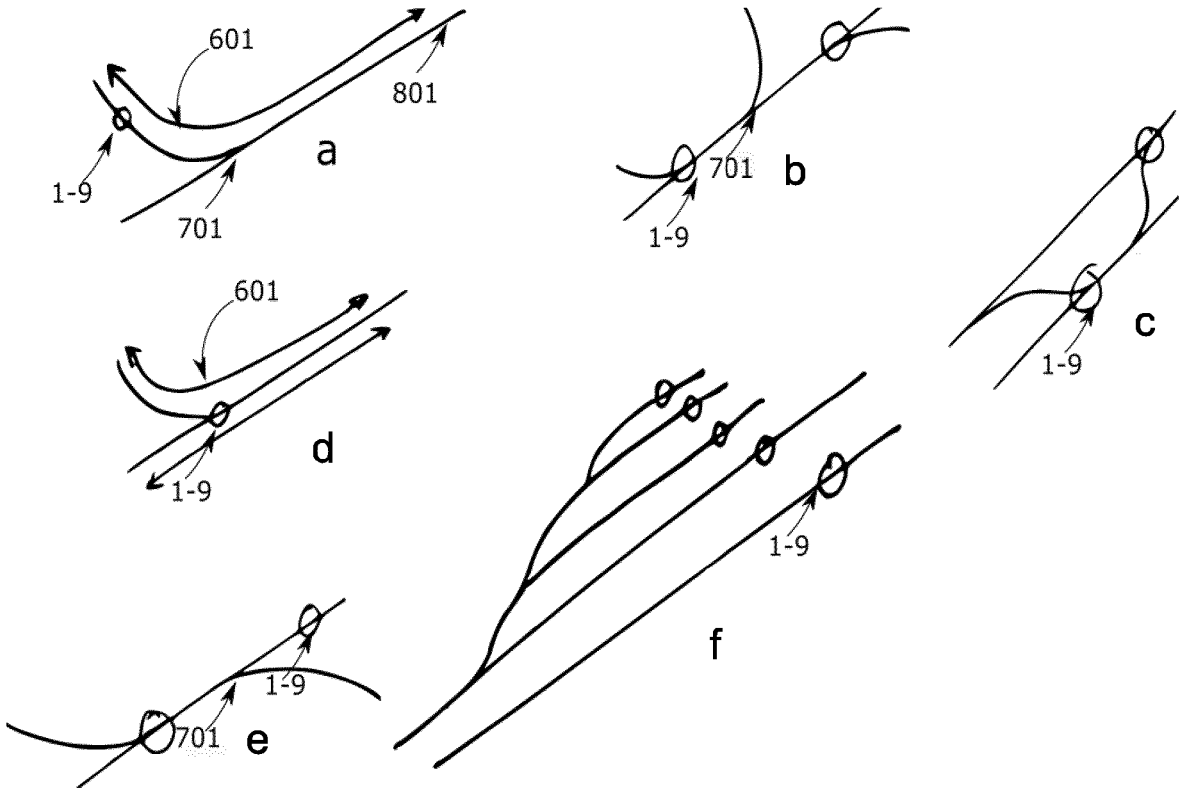
FIG. 3 schematically shows an exemplary operation of the system.

FIG. 3 shows an exemplary network layout of the sensor nodes 1-9 in a railway infrastructure. The sensor nodes 1-9 can be installed in a proximity of the switch 701 as shown in a, wherein the 601 is the path of the rail vehicle and 801 is the railway track.

In FIGS. 3*b, c, d, e* and *f*, respectively, different embodiments related to installation of sensor node 1-9 in proximity of switch 701 and railway track 801 can be seen. This can facilitate a full coverage of the vehicle path 601.

Reference numbers and letters appearing between parentheses in the claims, identifying features described in the embodiments and illustrated in the accompanying drawings, are provided as an aid to the reader as an exemplification of the matter claimed. The inclusion of such reference numbers and letters is not to be interpreted as placing any limitations on the scope of the claims.

The term "at least one of a first option and a second option" is intended to mean the first option or the second option or the first option and the second option.

Whenever a relative term, such as "about", "substantially" or "approximately" is used in this specification, such a term should also be construed to also include the exact term. That is, e.g., "substantially straight" should be construed to also include "(exactly) straight".

Whenever steps were recited in the above or also in the appended claims, it should be noted that the order in which the steps are recited in this text may be accidental. That is, unless otherwise specified or unless clear to the skilled person, the order in which steps are recited may be accidental. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

The invention claimed is:

1. A system, comprising:

a. at least one processing component;

b. a plurality of sensor nodes;

wherein, the processing component is configured to receive sensor data from the sensor nodes;

c. at least one trajectory module, wherein the trajectory module is configured to generate at least a part of trajectory data, based on sensor data; and d. a sensor routine module, wherein the sensor routine module is configured to generate sensor installing data.

2. The system according to claim 1 wherein the trajectory module is configured to pull sensor data from the processing component.

3. The system according to claim 1 wherein the trajectory module is configured to exchange data with at least one base station.

4. The system according to claim 3 wherein the trajectory module is further configured to fuse data sourced by the at least two of the sensor node;

the base station;

the processing component;

a user device.

5. The system according to claim 4 wherein the trajectory data is configured to be generated by the trajectory module based on user data sensed by the user device.

6. The system according to claim 1 wherein the trajectory module comprises at least one machine learning component, wherein the machine learning component further comprises at least one neural network architecture.

7. The system according to claim 1 wherein the trajectory data at least comprises direction data, wherein the trajectory data is configured to be generated based on at least sensor data recorded at the at least one sensor node.

8. The system according to claim 7 wherein the sensor data comprises at least one of frequency data and acceleration data and acoustic data and pressure data and strain data and humidity data and temperature data and inclination data.

9. The system according to claim 1 wherein the trajectory data is configured to be predicted based on at least sensor data recorded at the at least one sensor node.

10. The system according to claim 1 wherein the trajectory data is configured to be predicted based on electric current variation in a point machine.

11. The system according to claim 1 wherein the trajectory data is generated based on the sensor data from the plurality of sensor nodes using a time shift method.

12. The system according to claim 1 wherein the sensor installing data comprises at least one of optimized geographical location for sensor node installment and an optimized number of sensor nodes to be installed.

13. The system according to claim 1, wherein the sensor routine module is configured to generate at least part of sensor installing data based on trajectory data.

14. The system according to claim 1 wherein the sensor routine module comprises a self-improving neural network architecture.

15. A method comprising the steps of:

a. obtaining sensor data from at least one or a plurality of sensor node(s);

b. automatically generating at least part of trajectory data based on sensor data; and c. generating sensor installing data.

* * * * *